US010163431B2

(12) United States Patent
Mills

(10) Patent No.: US 10,163,431 B2
(45) Date of Patent: Dec. 25, 2018

(54) NON-LINEAR PICKUP FOR STRING INSTRUMENTS

(71) Applicant: Christopher Mills, Wayne, PA (US)

(72) Inventor: Christopher Mills, Wayne, PA (US)

( * ) Notice: Subject to any disclaimer, the term of this patent is extended or adjusted under 35 U.S.C. 154(b) by 0 days.

(21) Appl. No.: 15/891,921

(22) Filed: Feb. 8, 2018

(65) Prior Publication Data

US 2018/0322857 A1 Nov. 8, 2018

Related U.S. Application Data

(60) Provisional application No. 62/500,716, filed on May 3, 2017.

(51) Int. Cl.

| | |
|---|---|
| ***G10H 3/18*** | (2006.01) |
| *G10D 1/08* | (2006.01) |
| *G10D 1/10* | (2006.01) |

(52) U.S. Cl.

CPC ..... *G10H 3/181* (2013.01); *G10D 1/085* (2013.01); *G10D 1/10* (2013.01); *G10H 2220/461* (2013.01)

(58) Field of Classification Search

CPC ... G10H 3/181; G10H 2220/461; G10H 3/222
USPC ..... 84/726
See application file for complete search history.

(56) References Cited

U.S. PATENT DOCUMENTS 2,045,917 A * 6/1936 Miessner ..... G10H 3/18 84/173
2,307,454 A * 1/1943 Demuth ..... G10H 3/18 84/188
2,892,371 A 6/1959 Butts
2,896,491 A * 7/1959 Lover ..... G10H 3/181 84/725
2,933,967 A * 4/1960 Riscol ..... G10H 3/181 84/726
2,964,985 A * 12/1960 Webster ..... G10H 3/183 84/267
2,988,946 A 6/1961 Ritchie
3,177,283 A * 4/1965 Fender ..... G10H 3/181 84/726
3,249,677 A * 5/1966 Burns ..... G10H 3/182 84/726
3,518,353 A * 6/1970 Appleton ..... G10H 3/181 84/726

(Continued)

OTHER PUBLICATIONS

Michael Duddles, https://musicalilluminism.files.wordpress.com/2009/04/humbucker-internals1.jpg, 1 page, downloaded Jun. 18, 2015.

(Continued)

*Primary Examiner* — David Warren
(74) *Attorney, Agent, or Firm* — Gianna J. Arnold; Brian R. Landry; Saul Ewing Arnstein & Lehr LLP

(57) ABSTRACT

One aspect of the invention provides a pickup for a string instrument. The pickup includes: a plurality of pole pieces arranged along a non-linear path and a wire coil formed around said plurality of pole pieces and having a profile corresponding to said non-linear path. Another aspect of the invention provides a string instrument including: the pickup as described herein and a plurality of strings. Each string of said plurality of strings passes over a respective pole piece of said plurality of pole pieces.

17 Claims, 4 Drawing Sheets

(56) References Cited

U.S. PATENT DOCUMENTS 3,530,756 A * 9/1970 Chapman ..... G10C 3/161 84/726
3,691,285 A * 9/1972 Larrison ..... G10H 3/18 84/293
3,911,777 A 10/1975 Rendell
4,026,178 A * 5/1977 Fuller ..... G10H 3/183 84/726
4,050,341 A * 9/1977 Underwood ..... G10D 1/085 84/726
4,188,849 A * 2/1980 Rickard ..... G10H 3/181 84/726
4,378,722 A * 4/1983 Isakson ..... G10H 3/185 84/726
4,501,186 A * 2/1985 Ikuma ..... G10H 3/182 84/726
4,765,219 A * 8/1988 Alm ..... G10D 1/02 224/910
4,869,144 A * 9/1989 Lieber ..... G10H 3/183 336/110
D319,456 S * 8/1991 Fender ..... D17/20
5,070,759 A * 12/1991 Hoover ..... G10H 3/18 84/726
5,111,728 A * 5/1992 Blucher ..... G10H 3/182 84/726
5,292,999 A * 3/1994 Tumura ..... G10H 3/181 84/728
5,389,731 A * 2/1995 Lace ..... G10H 3/181 84/726
5,525,750 A * 6/1996 Beller ..... G10H 3/182 84/726
5,610,357 A * 3/1997 Frank-Braun ..... G10H 3/181 84/726
6,162,984 A * 12/2000 Engard ..... G10H 3/183 84/743
6,216,059 B1 * 4/2001 Ierymenko ..... G10H 3/181 700/280
6,992,243 B2 * 1/2006 Small ..... G10H 3/183 84/267
7,612,282 B1 * 11/2009 Lawing ..... G10H 3/181 84/725
7,989,690 B1 * 8/2011 Lawing ..... G10H 3/181 84/723
7,994,413 B2 8/2011 Salo
D650,004 S 12/2011 Lawing
8,664,507 B1 * 3/2014 Lawing ..... G10H 3/143 84/723
8,853,517 B1 10/2014 Dixon
8,889,977 B1 11/2014 Gage et al.
8,969,701 B1 3/2015 Dixon
9,704,464 B1 * 7/2017 Petschulat ..... G10H 3/181
9,842,580 B1 * 12/2017 Krasnov ..... G10H 3/182
2010/0122623 A1 * 5/2010 Salo ..... G10H 3/181 84/726
2013/0239788 A1 9/2013 Mills et al.
2013/0333545 A1 12/2013 Dunwoodie
2014/0245877 A1 9/2014 Gelvin
2015/0053069 A1 * 2/2015 Heil ..... G10H 3/181 84/726
2018/0012582 A1 * 1/2018 Kober ..... G10H 3/181

OTHER PUBLICATIONS

Kinman, "Guitar Pickups", http://www.kinman.com/guitar-pickups/kinman-pickups, 1 page, downloaded Jun. 18, 2015.
Wikipedia, "Humbucker", https://wikipedia.org/wiki/Humbucker, 5 pages, downloaded Jun. 18, 2015.
Dantzig, "Three's Company: The Pickup Placement Paradigm", Premier Guitar, www.premierguitar.com/articles/19300-threes-company-the-pickup-placement-paradigm, 4 pages, Jul. 18, 2013.
Sweetwater, "What is the Difference Between a Neck and a Bridge Pickup?", www.sweetwater.com/insync/what-is-the-difference-between-a-neck-and-a-bridge-pickup/, 2 pages, May 27, 2014.

* cited by examiner

NON-LINEAR PICKUP FOR STRING INSTRUMENTS

CROSS-REFERENCE TO RELATED APPLICATION

This application claims priority to U.S. Provisional Application Ser. No. 62/500,716, filed May 3, 2017. The entire content of this application is hereby incorporated by reference herein.

FIELD OF INVENTION

The disclosure relates generally to pickups for musical instruments, and, more specifically, to a pickup for a musical instrument having pole pieces disposed along a non-linear path.

BACKGROUND OF THE INVENTION

Many string instruments have pickups that convert vibrations of a string instrument to an electrical signal where it may be amplified and reproduced through loudspeakers or provided to a recording device. Pickups are commonly available in two forms: magnetic pickups and piezoelectric pickups. Magnetic pickups are typically included within electric guitars, electric basses, electric banjos and similar devices and typically consist of one or more magnetic poles wrapped with a coil of several thousand turns of copper wire and are typically mounted on the body of an instrument. The one or more magnetic pole pieces create a magnetic field that is disturbed by the motion of the vibrating strings, changing the magnetic flux and inducing an electric current through the coil. The pickup is typically communicatively coupled with an amplifier and/or recording equipment.

SUMMARY OF THE INVENTION

One aspect of the invention provides a pickup for a string instrument. The pickup includes: a plurality of pole pieces arranged along a non-linear path and a wire coil formed around said plurality of pole pieces and having a profile corresponding to said non-linear path.

This aspect of the invention can have a variety of embodiments. The non-linear path can be at least partially curved.

The pickup can further include a bobbin having a recess. The wire coil can be disposed within said recess. The bobbin can include a profile corresponding to said non-linear path. The bobbin can further include a plurality of hollow posts. The plurality of hollow posts can include at least one movable hollow post.

The plurality of pole pieces can include at least four pole pieces. The plurality of pole pieces can include at least six pole pieces.

A distance between a first pole piece of said plurality of pole pieces and a second pole piece of said plurality of pole pieces can be greater than a distance between said second pole piece and a third pole piece of said plurality of pole pieces. A distance between each pole piece of said plurality of pole pieces can be similar.

Each of said plurality of pole pieces can be magnets. Each of said plurality of pole pieces can be ferromagnetic materials lying within a magnetic field.

Another aspect of the invention provides a string instrument including: the pickup as described herein and a plurality of strings. Each string of said plurality of strings passes over a respective pole piece of said plurality of pole pieces.

This aspect of the invention can have a variety of embodiments. The string instrument can be one of an electric guitar, an electric bass guitar, and an electric banjo.

The string instrument can further include a second pickup including: a second plurality of pole pieces arranged along a second non-linear path and a second wire coil formed around said second plurality of pole pieces and having a profile corresponding to said second non-linear path. The second non-linear path and said non-linear path can be mirror symmetric. The pickup can further include a first bobbin and said second pickup can include a second bobbin. The first bobbin can include a first bobbin profile and said second bobbin can include a second bobbin profile. The first bobbin profile and said second bobbin profile can be mirror symmetric. The first bobbin profile can correspond to said non-linear path and said second bobbin profile can correspond to said second non-linear path.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Without being bound by theory, Applicant asserts that conventional approaches to varying the tonal qualities of a pickup are limited as such approaches only rely upon varying a small number of parameters within the pickup. Applicant identified that by disposing pole pieces of a pickup along a non-linear path, the tonal qualities of the pickup can be further altered and enhanced. Pickups having pole pieces disposed along a non-linear path are described in greater detail within the following disclosure.

Figure 1:
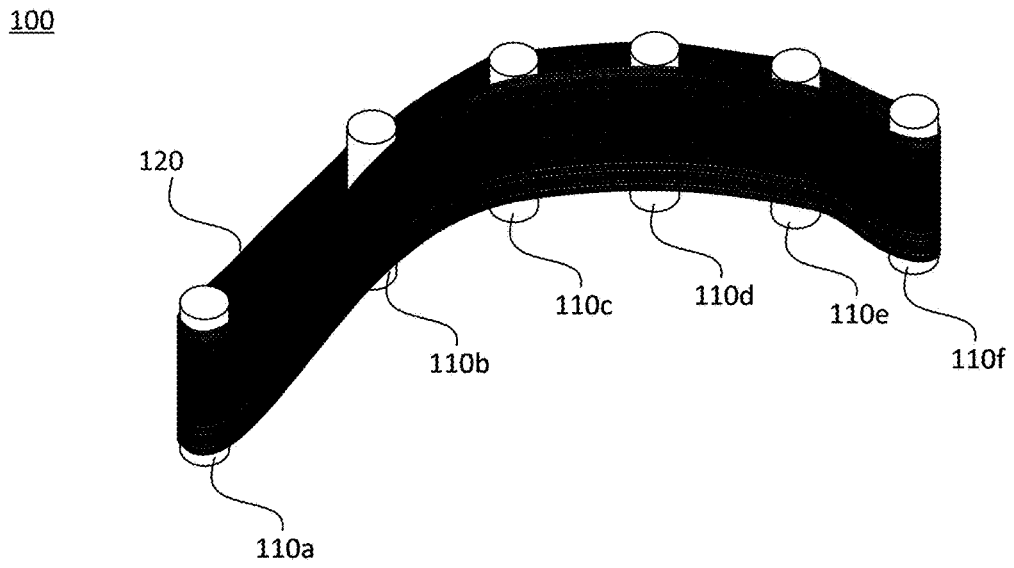
FIG. 1 is a perspective view of a pickup according to an embodiment of the disclosure.

Referring to FIG. 1, one embodiment of a pickup 100 for a string instrument is shown. The pickup 100 includes pole pieces 110 (110*a*-110*f*) and a coil 120. In various embodiments, the pickup 100 may further include a bobbin (e.g., bobbin 300 of FIG. 3 or bobbin 400 of FIG. 4). These elements and others will be described below in greater detail.

Figure 2:
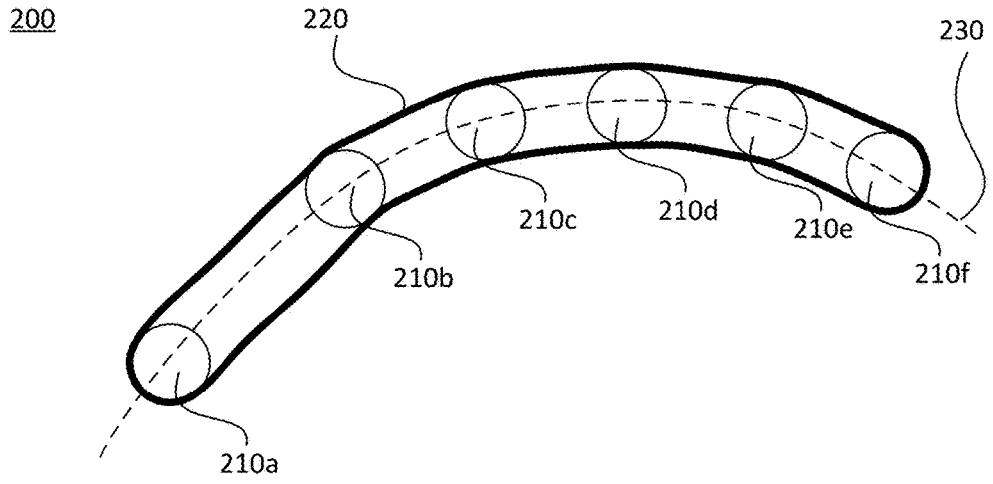
FIG. 2 is a top view of a pickup according to an embodiment of the disclosure.

As illustrated in FIGS. 1 and 2, the pickup 100 includes a plurality of pole pieces (pole pieces 110*a*-110*f*). In one or more embodiments, the pole pieces 110 are (but need not be) aligned with the strings of a string instrument and serve as a magnetic conductor for a corresponding string. Various spring spacing conventions exists and spacing rulers are available, for example, from Stewart-McDonald of Athens, Ohio.

In one embodiment, the pole pieces are aligned along a non-linear path. For example, as is illustrated by the top view of pickup 200 in FIG. 2, pole pieces 210 (210*a*-210*f*) are aligned along non-linear path 230. In one embodiment, the non-linear path 230 is at least partially curved. For example, the non-linear path 230 may include a single curved portion. Further, the non-linear path 230 may have at least one linear portion and at least one curved portion. Further yet, the non-linear path 230, may have at least two linear portions aligned in a non-linear fashion. Additionally, the non-linear path 230 may have a first curved portion and a second curved portion, where the curved portions may differ in at least one of a radius and direction. In one embodiment, the pole pieces 230 are disposed along a non-linear path such that a first pole piece interacts with a corresponding string of a string instrument differently than a second pole piece interacts with a corresponding string of the string instrument. For example, the pole pieces may interact with corresponding strings at different distances from a common reference point. In one embodiment, these distances both increase and decrease from a first end of the pickup to a second end of the pickup.

With further reference to FIG. 1, the pickup 100 can include six pole pieces 110*a*-110*f*. However, in other embodiments, the pickup 100 may include less than or more than six pole pieces. For example, the pickup 100 may include 4, 5, 12 or 24 pole pieces. Further, the pickup 100 may include a pole piece for each string of a corresponding instrument. In one embodiment, the pickup 100 comprises a single pole piece 110 configured to interact with each string of a corresponding instrument. As is described in relation to multiple pole pieces, the single pole piece may be formed into a shape having a non-linear path.

In various embodiments, the distances between adjacent pole pieces 110 is based on the distances of corresponding strings of an instrument. The pole pieces 110 may be configured to be centered under corresponding strings, defining the spacing or distance between pole pieces 110.

In one embodiment, the distance between a first adjacent pair of pole pieces 110 differs from the distance between a second adjacent pair of pole pieces 110. For example, the distance between pole piece 210*a* and pole piece 210*b* may differ from the distance between pole piece 210*b* and 210*c*. In other embodiments, the distances between each adjacent pair of pole pieces 110, 210 is the same. Further, distances between each adjacent pair of pole pieces may differ. Further yet, at least one distance between adjacent pole pieces differs from the others.

In various embodiments, each pole piece 110 includes a magnetic material. In other embodiments, each pole pieces includes a ferromagnetic material lying within a magnetic field, e.g., induced by a magnet otherwise coupled with the pole pieces 110, 210. In one embodiment, each pole piece includes steel coupled with one or more magnets. For example, each pole piece may be a steel bolt or rod that is coupled with a magnet sitting below the poles 110.

The orientation of the pole pieces 110, 210 determines the direction of the magnetic field within the pickup 100. For example, the pole pieces may be configured to create a north or south magnetic charge. The direction of the magnetic charge may also be referred to as the polarity of the pickup.

With continued reference to FIG. 1, a wire coil 120 is disposed around pole pieces 110. The wire coil 120 includes several thousand turns of wire, e.g., fine wire such as 42 or 43 AWG. The wire may be coated with an insulator such as enamel, polymer, polyurethane, and the like. The wire can have a copper conductor or use other ductile metals such as aluminum, cadmium, niobium (also known as "columbium"), copper, gold, iron, nickel, platinum, silver, tantalum, titanium, zinc, zirconium, and the like, and alloys thereof. In one embodiment, the wire coil 120 may be coated after winding (e.g., through dip coating) to reduce feedback.

As is illustrated in the embodiment of FIG. 2, the wire coil 220 can have a profile corresponding to the non-linear path of pole pieces 210. For example, the wire coil can have a uniform or substantially uniform distance from a non-linear path connecting the pole pieces 110, 210.

A first end of the wire coil may be coupled to a positive connection and the second end of the wire coil may be coupled a negative connection of an amplifier and/or recording device such that electrical signals corresponding to disruptions in the magnetic field of the pickup may be communicated to the amplifier and/or recording device. The wire coil may be referred to as having a direction of wind. The direction of wind corresponds to the path that electricity flows through the wire coil and is defined by which ends of the wire coil are coupled to positive and negative (or ground) connections. The coil can be connected to a phone connector (e.g., a ¼" phone jack, also known as a TS connector) for coupling to an amplifier.

Figure 3:
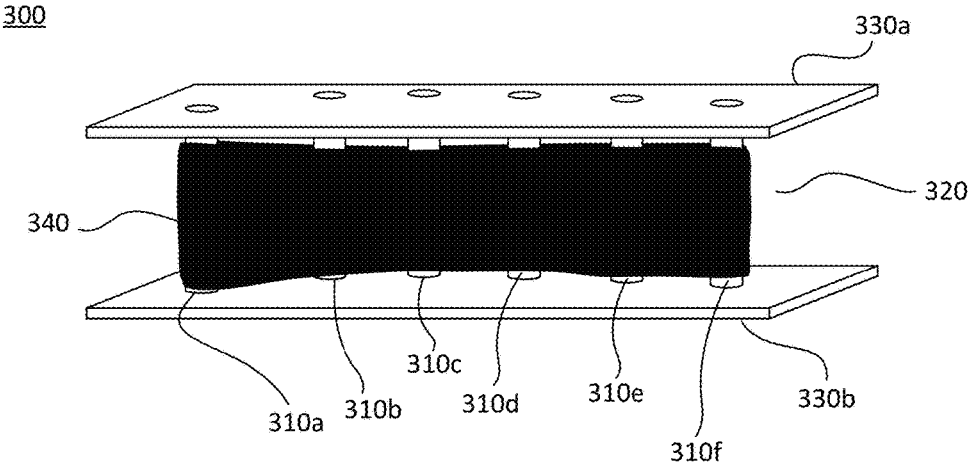
FIGS. 3 and 4 are perspective views of a bobbin according to embodiments of the disclosure.
Figure 4:
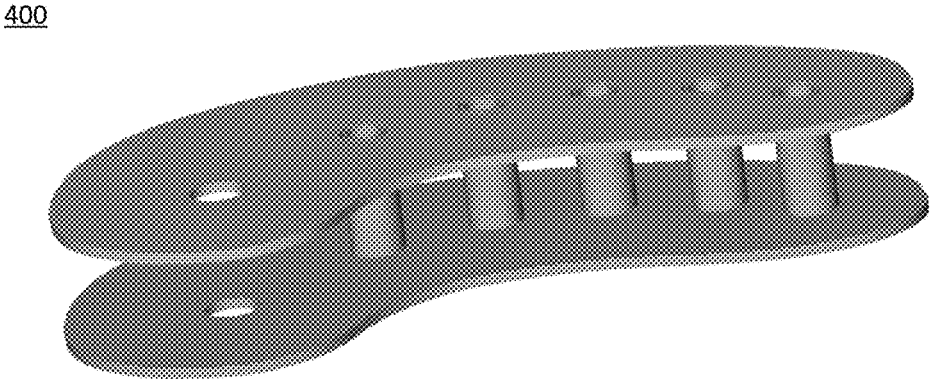

FIG. 3 illustrates an embodiment of a bobbin 300. In the illustrated embodiment, bobbin 300 includes a recess 320 and top and bottom support members (330*a* and 330*b*). The recess 320 can be defined by the top and bottom support members (330*a* and 330*b*). In one embodiment, the bobbin 300 further includes a plurality of hollow posts 310 and the recess 320 is further defined by the plurality of posts 310. Further, a wire coil 340 can be disposed within the recess 320 of bobbin 300.

In various embodiments, one or more of the pole pieces 110 may be housed within corresponding hollow posts. In one embodiment, bobbin 300 includes an equal number of hollow posts 310 as pole pieces 110 of the pickup. In other embodiments, bobbin 300 includes less hollow posts than pole pieces of a pickup. In such embodiments, the bobbin 300 may include one more holes within support members 330*a* and 330*b* configured to receive a corresponding pole piece.

In other embodiments, the top and bottom support members (330*a* and 330*b*) include a plurality of holes configured to receive pole pieces, (e.g., pole pieces 110 and 210). The pole pieces are positioned within corresponding holes of the first and second support members (330*a* and 330*b*) and couple the first and second support members (330*a* and 330*b*) with each other. In such embodiments, the bobbin 300 may or may not include hollow posts (e.g., hollow posts 310 configured to receive pole pieces (e.g., pole pieces 110 or 210)).

In one embodiment, the bobbin 300 may be one continuous piece of plastic formed using plastic molding techniques, 3D printing, or a similar process. In other embodiments, the support member 330*a* and support member 330*b* and/or hollow members 310 are separately formed and then coupled together to form the bobbin 300.

As is illustrated in FIG. 3, the profile of the bobbin 300 can be rectangular in shape. However, in other embodiments, the profile of bobbin 300 may be substantially circular, or elliptical in shape. Without being bound by theory, Applicant believes that any bobbin 300 can have any profile that facilitates mounting within a string instrument. Further, in various embodiments, the profile of bobbin 300 may include one or more curved or angle portions. In the embodiment illustrated in FIG. 4, a bobbin 400 has a profile substantially similar to that of the non-linear path 230.

Figure 7:
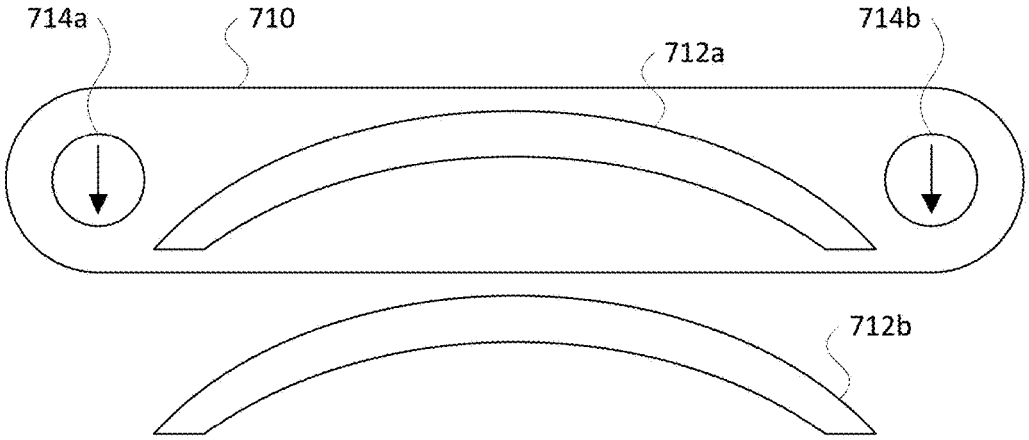
FIG. 7 illustrates an approach for forming a nonlinear coil according to an embodiment of the invention.

In one embodiment, the wire coil 120, 220, 340 may be formed separately from the bobbin 300 and then placed over the posts of the bobbin. For example, a wire coil 120, 220, 340 may be formed around a mandrel and then placed over the posts of the bobbin. Referring to FIG. 7, for example, a relatively rectangular coil 720 can be placed over a mandrel including two curved surfaces 712*a*, 712*b* and then pulled by posts or hooks 714*a*, 714*b* to form the desired profile. The initial dimensions of relatively rectangular coil 720 can be engineered to anticipate deformation, stretching, and the like and produce the desired non-linear shape after removal from the mandrel.

The wire coil may be formed such that it has a profile corresponding to that of the pole pieces before it is placed around the pole pieces. In other embodiments, the wire coil may be formed around the hollow posts of a bobbin and then shaped such that its profile is similar to the non-linear path of the pole pieces. In such an embodiment, one or more hollow pieces may be configured to be moveable such that the distance between hollow pieces may be decreased to allow the wire coil to be pressed and formed into profile similar to the non-linear path of the pole pieces (particularly on concave portions of the non-linear path). In one embodiment, hollow piece 310*a* is configured to be moveable, such that the distance between hollow pieces 310*a* and 310*b* may be reduced. In another embodiment, hollow piece 310*f* is configured to be movable, such the distance between hollow pieces 310*f* and 310*e* may be reduced. In yet another embodiment, both hollow pieces 310*a* and 310*f* may be configured to be moveable. For example, tension applied to a hollow piece may be reduced, allowing the hollow piece to be moved. In particular, a pole piece inserted through the hollow piece may be loosened, allowing the hollow piece to be moved. The pole piece may be a bolt coupled to a nut and the nut may be at least partially removed from the pole piece to allow the hollow piece to be moved. The nut may be external to bobbin 300 or may be part of either support member 330*a* or 330*b*. In another embodiment, a moveable hollow post may configured to move in such that it is at least partially deformed, allowing the wire coil to be shaped. A movable hollow post may include at least one of a different material and shape from a non-movable hollow post.

Figure 5:
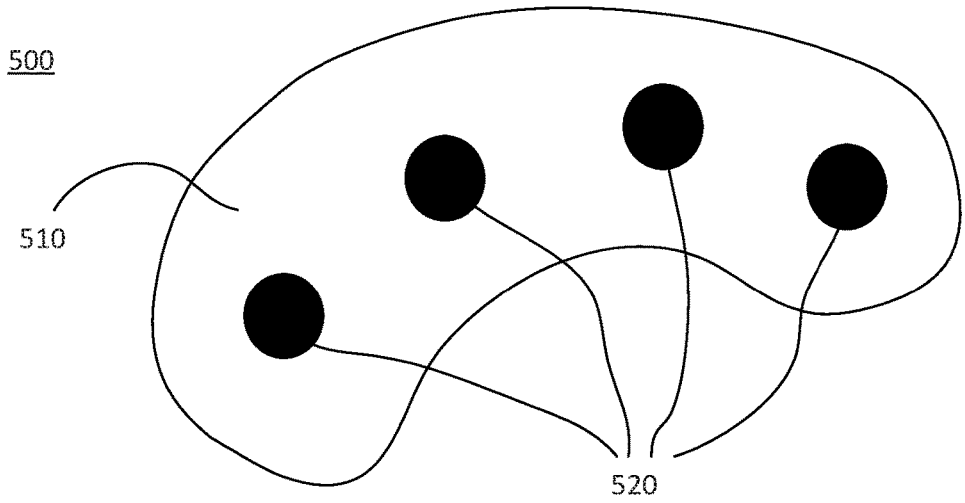
FIG. 5 is a top view of a pickup according to an embodiment of the disclosure.

FIG. 5 illustrates a top view of a pickup 500 including a bobbin 510 and pole pieces 520. As is illustrated, the bobbin 510 has a profile corresponding to that of the pole pieces 520. Further, in the illustrated embodiment, the pickup 500 includes four pole pieces 520. As is mentioned above, in other embodiments, the pickup 500 may include more or less than four pole pieces.

Figure 6:
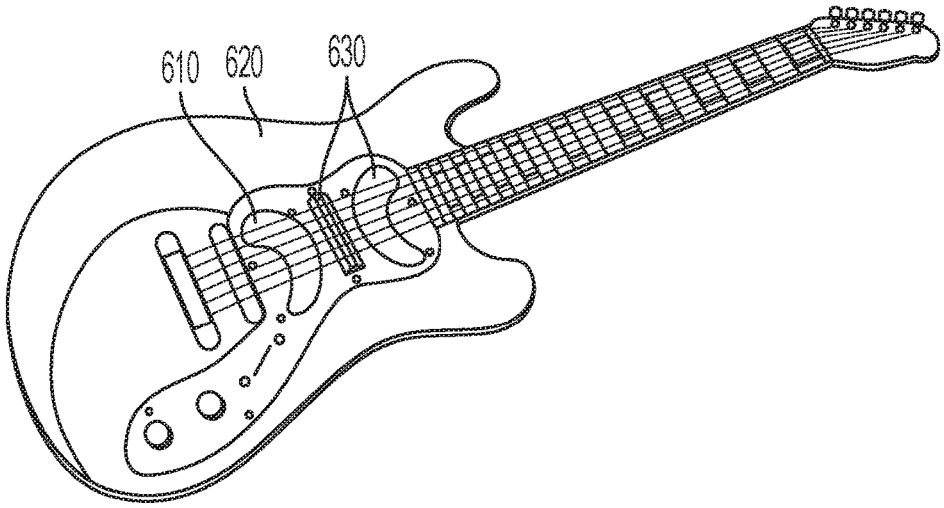
FIG. 6 illustrates a string instrument comprising one or more pickups according to embodiments of the disclosure.

In the embodiment of FIG. 6, a pickup 610 is included within a string instrument 620 such as an electric guitar. Embodiments of the invention can be applied to a variety of string instruments including, but not limited to, an electric bass, an electric banjo, an electric violin, and the like. The pickup 610 comprises one or more pole pieces. Each pole piece can be aligned with a corresponding string of the string instrument 620. In one embodiment, the string instrument 620 may further include one or more additional pickups 630, which can be linear or non-linear.

Pickups 610, 630 and/or poles can be covered by various materials for aesthetic purposes. Such coverings are preferably non-conductive materials such as polymers, plastics, fabrics, and the like.

In one embodiment, the first pickup 610 and a second pickup 630 have the same polarity and direction of wind of corresponding wire coil. In another embodiment, the pickup 610 and the pickup 630 have opposite polarities and directions of wind forming a humbucking configuration. In other embodiments, the pickup 610 and the pickup 630 differ in polarity but have the same direction of wind. In further embodiments, the pickup 610 and the pickup 630 have the same polarity but differ in wind direction. In various embodiments, the electric guitar 620 may include one or more switches configured to control at least one of the polarity and direction of wind.

As is illustrated in FIG. 6, the pickup 610 and the pickup 630 may be mirror symmetric. In one embodiment, both the non-linear paths of the pole pieces and the profile of each pickups may be mirror symmetric. In another embodiment, the non-linear paths of the pole pieces of each pickup are mirror symmetric and profile of the pickups are not mirror symmetric. Further, in other embodiments, the profile of the pickups are mirror symmetric while the non-linear paths of the pole pieces are not mirror symmetric.

In various embodiments, pole pieces for different pickups may be disposed along different non-linear paths, such that each pickup produces different tonal qualities. In one embodiment, a first pickup of a string instrument may have a non-linear path and a second pickup of the string instrument may have a linear path. For example, a pickup having a linear path may be placed between two pickups having non-linear paths. Additionally, a pickup having a linear path may be placed after each pickup having a non-linear path. Further, a string instrument may comprise any combination of pickups having non-linear paths and pickups having linear paths.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A pickup for a string instrument, the pickup comprising:

a plurality of pole pieces arranged along a fully curved path; and a wire coil formed around said plurality of pole pieces and having a profile corresponding to said fully curved path.

2. The pickup of claim 1, further comprising a bobbin having a recess.

3. The pickup of claim 2, wherein said wire coil is disposed within said recess.

4. The pickup of claim 2, wherein said bobbin comprises a profile corresponding to said non-linear path.

5. The pickup of claim 2, wherein said bobbin further comprises a plurality of hollow posts.

6. The pickup of claim 1, wherein said plurality of pole pieces comprises at least four pole pieces.

7. The pickup of claim 1, wherein said plurality of pole pieces comprises at least six pole pieces.

8. The pickup of claim 1, wherein a distance between a first pole piece of said plurality of pole pieces and a second pole piece of said plurality of pole pieces is greater than a distance between said second pole piece and a third pole piece of said plurality of pole pieces.

9. The pickup up of claim 1, wherein a distance between each pole piece of said plurality of pole pieces is similar.

10. The pickup of claim 1, wherein each of said plurality of pole pieces are magnets.

11. The pickup of claim 1, wherein each of said plurality of pole pieces are ferromagnetic materials lying within a magnetic field.

12. A pickup for a string instrument, the pickup comprising:

a plurality of pole pieces arranged along a non-linear path;

a bobbin having a recess, wherein said bobbin comprises a plurality of hollow posts; and a wire coil formed around said plurality of pole pieces and having a profile corresponding to said non-linear path;

wherein said plurality of hollow posts includes at least one movable hollow post.

13. A string instrument comprising:

a pickup comprising:

a first plurality of pole pieces arranged along a first non-linear path; and a first wire coil formed around said first plurality of pole pieces and having a first profile corresponding to said first non-linear path;

a second pickup comprising:

a second plurality of pole pieces arranged along a second non-linear path; and a second wire coil formed around said second plurality of pole pieces and having a second profile corresponding to said second non-linear path;

wherein said second non-linear path and said first non-linear path are mirror symmetric; and a plurality of strings, wherein each string of said plurality of strings passes over a respective pole piece of said first and second plurality of pole pieces.

14. The string instrument of claim 13, wherein said string instrument is one of an electric guitar, an electric bass guitar, and an electric banjo.

15. The string instrument of claim 13, wherein said pickup of claim 1 further comprises a first bobbin and said second pickup comprises a second bobbin.

16. The string instrument of claim 15, wherein said first bobbin comprises a first bobbin profile and said second bobbin comprises a second bobbin profile, wherein said first bobbin profile and said second bobbin profile are mirror symmetric.

17. The string instrument of claim 16, wherein said first bobbin profile corresponds to said non-linear path and said second bobbin profile correspond to said second non-linear path.

* * * * *